US006175702B1

(12) United States Patent
Takeuchi et al.

(10) Patent No.: US 6,175,702 B1
(45) **Date of Patent: *Jan. 16, 2001**

(54) COLOR IMAGE FORMING APPARATUS WHICH PREVENTS THE SCATTER OF COLOR CHARACTERS AND LINES

(75) Inventors: Akihiko Takeuchi, Susono; Tatsuya Kobayashi, Soka; Toshiaki Miyashiro, Shizuoka-ken; Naoki Enomoto, Susono; Takaaki Tsuruya, Mishima; Kazuhiro Funatani, Numazu, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/053,744

(22) Filed: Apr. 2, 1998

(30) Foreign Application Priority Data

Apr. 4, 1997 (JP) ..... 9-087008
Mar. 25, 1998 (JP) ..... 10-077350

(51) Int. Cl.[7] ..... G03G 15/16
(52) U.S. Cl. ..... 399/101; 399/297; 399/302
(58) Field of Search ..... 399/101, 297, 399/298, 301, 302

(56) References Cited

U.S. PATENT DOCUMENTS

| | | | |
|---|---|---|---|
| 5,153,654 | 10/1992 | Yuminamochi et al. | 199/318 |
| 5,177,549 | 1/1993 | Ohtsuka et al. | 399/320 |
| 5,179,397 | 1/1993 | Ohzeki et al. | 399/168 X |
| 5,196,885 | 3/1993 | Takeuchi et al. | 399/168 |
| 5,214,480 | 5/1993 | Aoki et al. | 399/314 |
| 5,223,900 | 6/1993 | Yuminamochi et al. | 399/313 |
| 5,225,852 | 7/1993 | Uchida et al. | 346/134 |
| 5,249,023 | 9/1993 | Miyashiro et al. | 399/303 |
| 5,274,399 | 12/1993 | Uchida et al. | 346/134 |
| 5,287,163 | 2/1994 | Miyashiro et al. | 399/66 |
| 5,331,385 | 7/1994 | Ohtsuka et al. | 399/331 |
| 5,390,012 | 2/1995 | Miyashiro et al. | 399/303 |
| 5,508,796 | 4/1996 | Sasame et al. | 399/18 |
| 5,523,829 | 6/1996 | Miyashiro et al. | 399/396 |
| 5,539,507 | 7/1996 | Miyashiro et al. | 399/298 |
| 5,543,904 | 8/1996 | Kato et al. | 399/335 |
| 5,666,597 | 9/1997 | Sasame et al. | 399/128 |
| 5,701,568 * | 12/1997 | Hiroshima et al. | 399/302 |
| 5,732,310 * | 3/1998 | Hiroshima et al. | 399/101 |
| 5,737,677 * | 4/1998 | Tombs et al. | 399/298 X |
| 5,752,130 * | 5/1998 | Tanaka et al. | 399/101 |
| 5,761,571 | 6/1998 | Suzuki et al. | 399/66 |
| 5,809,373 * | 9/1998 | Yoda et al. | 399/101 |
| 5,890,030 * | 3/1999 | Namekata et al. | 399/302 X |

* cited by examiner

*Primary Examiner*—William J. Royer
(74) *Attorney, Agent, or Firm*—Fitzpatrick, Cella, Harper & Scinto

(57) ABSTRACT

A color image forming apparatus has developing unit, an image bearing member capable of bearing thereon toner images of plural colors formed by the developing unit, a rotatable intermediate transferring member, transferring unit for transferring the toner images of plural colors on the image bearing member to the intermediate transferring member at a first transferring position in electrostatically superposed relationship with one another, and a charger for charging any residual toner remaining on the intermediate transferring member after the toner images on the intermediate transferring member transferred by the transferring unit have been transferred to a transfer material at a second transferring position to a polarity opposite to the regular charging polarity of the toners in the developing unit. Simultaneously with the next toner image on the image bearing member being transferred to the intermediate transferring member at the first transferring position by the transferring unit, the residual toner charged by the charger is transferred to the image bearing member at the first transferring position by the transferring unit, and the first toner image transferred from the image bearing member to the intermediate transferring member at the first transferring position by the transferring unit is a black toner image.

43 Claims, 13 Drawing Sheets

FIG. 4

| | CHARACTER COLOR | COLOR SEQUENCE | | | | SCATTER OF COLOR CHARACTER |
|---|---|---|---|---|---|---|
| | | 1 | 2 | 3 | 4 | |
| FIRST EMBODIMENT | RED | – | Y | M | – | A |
| | BLUE | – | – | M | C | A |
| | GREEN | – | Y | – | C | A |
| PRIOR ART | RED | Y | M | – | – | B TO C |
| | BLUE | – | M | C | – | A |
| | GREEN | Y | – | C | – | B |

SYMBOL { A : GOOD
B : ALLOWABLE
C : BAD

FIG. 5

| KIND OF ROLLER | DIAMETER (mm) | SCATTER LEVEL | | | $\alpha$ |
|---|---|---|---|---|---|
| | | RED | BLUE | GREEN | |
| 52 (DRIVE ROLLER) | 10 | C | C | C | 23 |
| | 20 | B | B TO A | B TO A | 46 |
| | 30 | A | A | A | 70 |
| | 40 | A | AA | AA | 93 |
| 53 (TENSION ROLLER) | 12 | C TO B | A | A | 45 |
| | 14 | B | A | A | 53 |
| | 16 | A | A | A | 61 |
| | 20 | A | A | A | 76 |
| 72 (OPPOSING ROLLER FOR SECONDARY TRANSFERRING) | 10 | C | A | A | 33 |
| | 15 | B | A | A | 49 |
| | 20 | B TO A | A | A | 66 |
| | 30 | A | A | A | 98 |
| | 40 | A | A | A | 131 |

SYMBOL
- AA : VERY GOOD
- A : GOOD
- B : ALLOWABLE
- C : BAD

FIG. 10

| | CHARACTER COLOR | COLOR SEQUENCE | | | | SCATTER OF COLOR CHARACTER |
|---|---|---|---|---|---|---|
| | | 1 | 2 | 3 | 4 | |
| THIRD EMBODIMENT | RED | – | Y | M | – | A |
| | BLUE | – | – | M | C | AA |
| | GREEN | – | Y | – | C | AA |
| PRIOR ART | RED | Y | M | – | – | B |
| | BLUE | – | M | C | – | A |
| | GREEN | Y | – | C | – | B TO A |

SYMBOL { AA : VERY GOOD
A : GOOD
B : ALLOWABLE
C : BAD

FIG. 11

| | CHARACTER COLOR | COLOR SEQUENCE | | | | VISUAL SCATTER OF COLOR CHARACTER |
|---|---|---|---|---|---|---|
| | | 1 | 2 | 3 | 4 | |
| FOURTH EMBODIMENT | RED | – | M | – | Y | AA |
| | BLUE | – | M | C | – | AA |
| | GREEN | – | – | C | Y | AA |
| PRIOR ART | RED | Y | M | – | – | B TO C |
| | BLUE | – | M | C | – | A |
| | GREEN | Y | – | C | – | B |

SYMBOL { AA : VERY GOOD
A : GOOD
B : ALLOWABLE
C : BAD

COLOR IMAGE FORMING APPARATUS WHICH PREVENTS THE SCATTER OF COLOR CHARACTERS AND LINES

BACKGROUND OF THE INVENTION

1. Field of the Invention

This invention relates to an image forming apparatus of a type which transfers a toner image formed on an image bearing member to a transfer material through an intermediate transferring member.

2. Related Background Art

In a color image forming apparatus of the electrophotographic type (for example, a copying apparatus or a laser beam printer), so-called primary transferring in which a toner image formed on a photosensitive drum as an image bearing member is once transferred onto an intermediate transferring member and is repeated a plurality of times to thereby superpose toner images of plural colors on the intermediate transferring member, and these toner images of plural colors are collectively secondary-transferred onto a transfer material such as paper.

FIG. 13 of the accompanying drawings shows an example of a color image forming apparatus using an intermediate transferring belt as the intermediate transferring member.

The image forming apparatus shown in FIG. 13 is provided with a photosensitive drum 101, and around the photosensitive drum 101 supported for rotation in the direction of arrow R1, there are disposed four developing devices 105, 106, 107 and 108 in which black (Bk) toner, cyan (C) toner, magenta (M) toner and yellow (Y) toner are contained respectively. One of these developing devices which is used for the development of an electrostatic latent image on the photosensitive drum 101 is designed to abut against the photosensitive drum 101 by means (not shown) for moving it toward and away from the photosensitive drum.

The photosensitive drum 101 is uniformly charged by a charger 102, and an electrostatic latent image is formed thereon by a laser beam (scanning light) 104 from a laser exposure optical system 103. Next, the electrostatic latent image is developed as toner images with the toners caused to adhere thereto by the developing devices 105–108, and in a primary transfer nip portion $N_1$, the toner images are primary-transferred onto an intermediate transferring belt 109 by a primary transferring roller 110. The formation, development and primary transferring of the electrostatic latent image are successively effected in the order of Y, M, C and Bk with respect to the four colors by the developing devices 108, 107, 106 and 105, whereby toner images of four colors superposed one upon another are formed on the intermediate transferring belt 109. These toner images are then collectively secondary-transferred onto a transfer material 118 conveyed while being held by and between a secondary transferring roller 111 and the intermediate transferring belt 109.

The primary transfer and the secondary transfer will further be described in detail. First, when the photosensitive drum 101 is, for example, an OPC (organic photosemiconductive) photosensitive member having a negative charged characteristic, toners of negative polarity are used to develop the exposed portion to which the laser beam 104 has been applied by the developing devices 108, 107, 106 and 105. Accordingly, a primary transfer bias of positive polarity is applied to the primary transferring roller 110 by a primary bias voltage source 120.

Here, as the intermediate transferring belt 109, use can be made, for example, an endless resin belt having a thickness of the order of 100 to 300 $\mu$m and resistance-adjusted to volume resistivity of the order of $10^{11}$ to $10^{16}$ Ω.cm. In this case, as the material of the resin belt, use can be made of resin film (resistance-adjusted as required) such as PVdF (polyvinylidene fluoride), nylon, PET (polyethylene terephthalate) or polycarbonate. Also, as another example, there is a case where the above-described resin belt is adjusted to a volume resistance value of the order of $10^7$ to $10^{11}$ Ω.cm by carbon, $ZnO_2$, $SnO_2$, $TiO_2$ or other electrically conductive filler and used. By achieving medium to low resistance like the latter, it is possible to prevent the formation of a bad image by charges being accumulated in the intermediate transferring belt 109.

As still another example, a rubber material (such as chloroprene rubber, EPDM, NBR or urethane rubber) having lower hardness than resin and having a thickness of the order of 0.5 to 2 mm and adjusted to volume resistivity of the order of $10^6$ to $10^{11}$ Ω.cm can be used as the material of the intermediate transferring belt 109.

The intermediate transferring belt 109 is passed over a back roller 112, a drive roller 115, and a tension roller 116. As the primary transferring roller 110, use is usually made of a low resistance roller having volume resistivity of $10^5$ Ω.cm or less. In the foregoing, the primary transferring roller 110 and the primary bias voltage source 120 together constitute primary transferring means.

Next, the secondary transferring of the toner images to the transfer material 118 is effected by secondary transferring means constituted by the secondary transferring roller 111, the back roller 112, the secondary bias voltage source 121. The secondary transfer is effected by disposing the back roller 112 of low resistance grounded or having a suitable bias applied thereto as an opposing electrode inside the intermediate transferring belt 109, holding the intermediate transferring belt 109 between the back roller and the secondary transferring roller 111 of low resistance disposed outside the intermediate transferring belt to thereby constitute a secondary transferring region $N_2$, applying a secondary transfer bias of positive polarity to the secondary transferring roller 111 by the secondary bias voltage source 121, and causing the secondary transferring roller 111 to bear against the transfer material 118 from the back side thereof.

After the above-described primary transferring has been completed, the photosensitive drum 101 has any residual toner of primary transferring remaining on its surface removed by a cleaner 119, and has any residual charges thereon removed by an exposure device 117, and is used for the formation of the next toner images.

On the other hand, after the above-described secondary transferring has been completed, the intermediate transferring belt 109 has any residual toner of secondary transferring remaining thereon removed by a cleaner 113, whereafter it has its charges removed by a charge removing charger (charge removing means) 114. AC corona charging is often used as the charge removing charger 114.

The charge removing charger 114 can be omitted when the intermediate transferring belt of low to medium resistance as previously described is used.

As the above-described intermediate transferring member, there is available an intermediate transferring drum besides the intermediate transferring belt 109, but generally the intermediate transferring belt 109 is excellent in the height of the degree of freedom of the disposition of the intermediate transferring member and the good separability of the transfer material 118 after the secondary transferring (the possibility of the separation of curvature in the bent portion of the belt), as compared with the intermediate transferring drum. In contrast, the intermediate transferring drum can be simplified in structure, as compared with a case where the belt is driven. Even in the case of the intermediate transferring drum, the electrical characteristic of a resin or rubber layer provided on the surface of an electrically conductive cylindrical member can be considered as in the case of the intermediate transferring belt 109 and therefore, detailed description will be omitted.

In the above-described image forming apparatus, the order of formation of the toner images of four colors (Y, M, C and Bk) (the order of primary transfer) has heretofore been such that toner images are formed in suitable order by the toners of three colors, i.e., Y toner, M toner and C toner, and finally a toner image is formed by Bk toner.

Also, instead of the cleaner 113 and charge removing charger 114 of FIG. 13, a charging roller 122 movable toward and away from the intermediate transferring belt 109 has heretofore been provided as shown in the image forming apparatus of FIG. 14 of the accompanying drawings. In FIG. 14, the construction is the same as that of FIG. 13 except for the charging roller 122, and like members are designated by like reference numerals. The charging roller 122 secondary-transfers the toner images of the intermediate transferring belt 109 to a transfer material, and thereafter charges any residual toner of secondary transferring remaining on the intermediate transferring belt 109 to a polarity opposite to the regular charging polarity of the toners in the developing devices. When an image is to be continuously formed, the next Y toner image on the photosensitive drum is primary-transferred to the intermediate transferring belt in the primary transfer nip portion by the primary transferring roller 110 and simultaneously therewith, the residual toner of secondary transferring charged by the charging roller 122 is transferred from the intermediate transferring belt 109 to the photosensitive drum 101. By doing so, the throughput of image formation has heretofore been improved.

However, the above-described example of the prior art has suffered from the following problem. Color characters and color lines (e.g. red characters and red lines=Y toner+M toner) of plural colors superposed one upon another formed on the intermediate transferring belt 109 by the use of color toners, i.e., Y toner, M toner and C toner and toners not yet formed on the intermediate transferring belt 109 (e.g. C toner and Bk toner) have been gradually scattered while the intermediate transferring belt 109 is rotated to form these toners on the intermediate transferring belt 109. Thereby, the hue or tone of the color characters and color lines has been changed and the resultant image has become bad. This is more liable to occur as the resistance of the intermediate transferring belt 109 becomes lower, and has been a remarkable problem in a belt type wherein as the intermediate transferring member, the intermediate transferring belt 109 as described above is bent by the inside rollers 112, 115 and 116. In contrast, it is possible to decrease the amounts of toners of respective colors (Y toner, M toner and C toner) to thereby improve the scatter thereof, but if this is done, another problem that the resultant image becomes light in color will arise.

Also, in the above-described image forming apparatus of FIG. 13, the order of the colors in the primary transferring is Y→M→C→Bk, i.e., Y toner which is a color toner (Y toner, M toner or C toner) as the first color and therefore, on this side of the vicinity of the nip formed in the primary transfer nip portion $N_1$ by the photosensitive drum 101 and the intermediate transferring belt 109 (the upstream side with respect to the direction of rotation of the intermediate transferring belt 109), the discharge of electricity in air occurs between the photosensitive drum 101 and the intermediate transferring belt 109 and as the result there has arisen the problem that the intermediate transferring belt 109 and the residual toner of secondary transferring on the intermediate transferring belt 109 is charged to the minus polarity immediately before primary transferring and therefore the residual toner of secondary transferring is not collected by the photosensitive drum 101.

SUMMARY OF THE INVENTION

It is the object of the present invention to provide an image forming apparatus which can prevent the formation of the bad images of color characters and color lines.

BRIEF DESCRIPTION OF THE DRAWINGS

FIG. 4 shows the relation between the order of formation of toner images and the scatter of color characters in the first embodiment.

FIG. 5 shows the relations among the diameters of rollers, the angle of twining and the scatter level in the first embodiment.

FIG. 10 shows the relation between the order of formation of toner images and the scatter of color characters in the third embodiment.

FIG. 11 shows the relation between the order of formation of toner images and the visual scatter of color characters in a fourth embodiment of the present invention.

DESCRIPTION OF THE PREFERRED EMBODIMENTS

Some embodiments of the present invention will hereinafter be described with reference to the drawings.

<First Embodiment>

Figure 1:
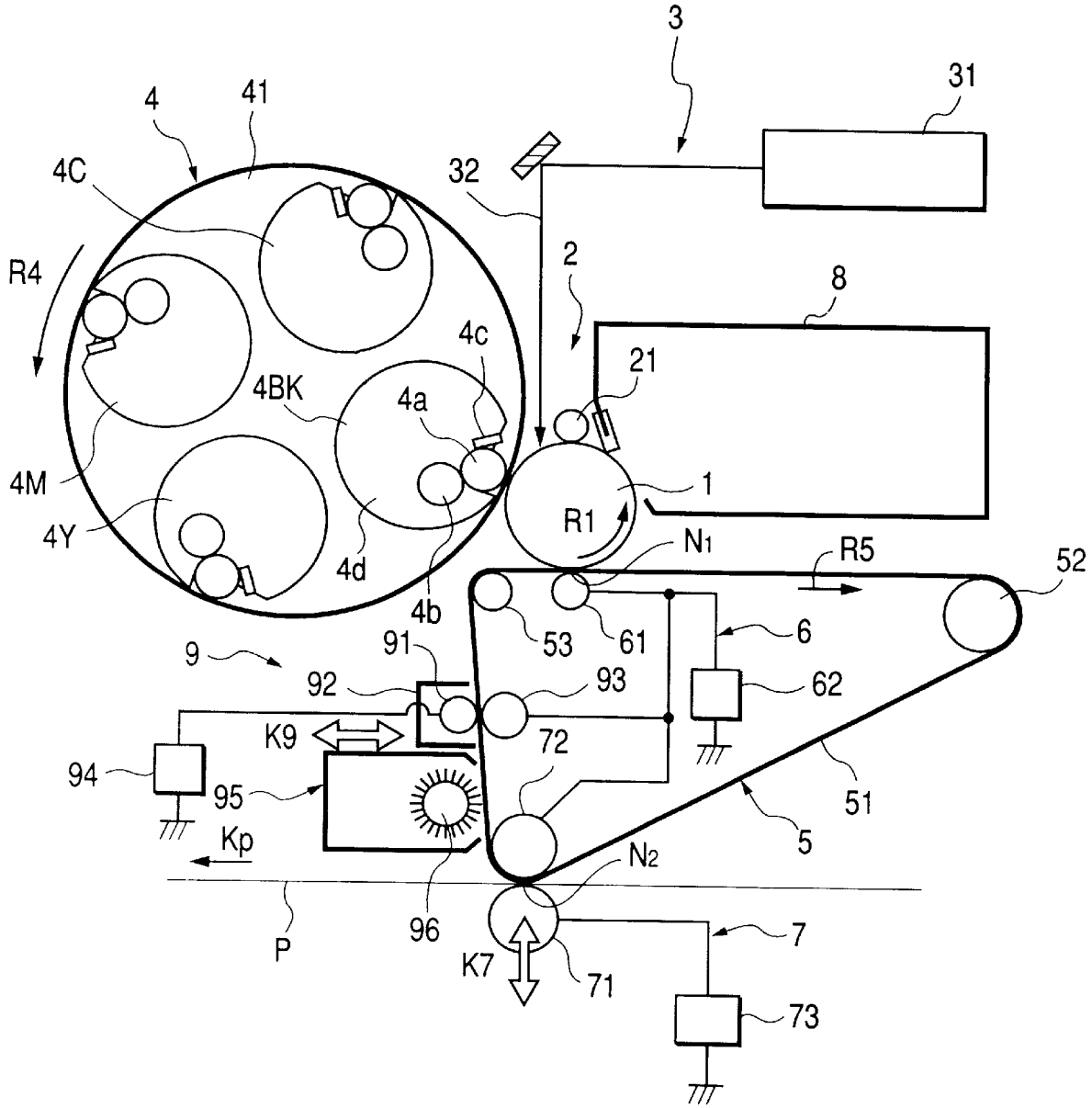
FIG. 1 schematically shows the construction of an image forming apparatus according to a first embodiment of the present invention.

FIG. 1 schematically shows the construction of a color image forming apparatus according to a first embodiment of the present invention.

Description will first be made of the epitome of the general construction and operation of the color image forming apparatus (hereinafter simply referred to as the "image forming apparatus") with reference to FIG. 1.

The image forming apparatus shown in FIG. 1 is a four-color full color image forming apparatus which is provided with the following members (means) 1 to 7 as main constituent members (means): an image bearing member 1, visualized image forming means 2, 3 and 4, an intermediate transferring member 5, first transferring means 6 and second transferring means 7. The epitome of the operation based on these main constituent members (means) is to form visualized images on the image bearing member 1 by the visualized image forming means 2, 3 and 4, once primary-transfer of the visualized images onto the intermediate transferring member 5 by the first transferring means 6, and thereafter transfer of the visualized images on the intermediate transferring member 5 onto a transfer material P such as paper by the second transferring means 7. These operations will hereinafter be successively described in detail.

The image bearing member 1 shown in FIG. 1 is a drum type electrophotographic photosensitive member (hereinafter referred to as the "photosensitive drum") 1. The photosensitive drum 1 is comprised of a cylindrical base body made of aluminum, and e.g. an OPC (organic photosemiconductive) photosensitive layer covering the surface thereof, and is rotatively driven in the direction of arrow R1 by driving means (not shown).

The visualized image forming means are comprised of charging means 2, exposure means 3, and developing means 4. The charging means 2 is provided with a charging roller 21 disposed in contact with the photosensitive drum 1, and a voltage source (not shown) for applying a charging bias to the charging roller 21. In the first embodiment, the surface of the photosensitive drum 1 is uniformly charged to a potential of minus polarity by this voltage source through the charging roller 21.

The exposure means 3 is provided with a laser optical system 31, and exposes the surface of the photosensitive drum 1 to laser scanning light 32 based on image information, and removes the charges of the exposed portion to thereby form an electrostatic latent image.

The developing means 4 is provided with a rotatable member 41 rotatable in the direction of arrow R4, and four developing devices carried thereon, i.e., developing devices 4Bk, 4Y, 4M and 4C containing therein black (Bk), yellow (Y), magenta (M) and cyan (C) developers (toners), respectively. Of these developing devices, the developing device of a color used for the development of the electrostatic latent image on the photosensitive drum 1 becomes disposed in a developing position opposed to the surface of the photosensitive drum 1 by the rotation of the rotatable member 41 in the direction of arrow R4 (in FIG. 1, the black developing device 4Bk is disposed in the developing position). These four developing devices are likewise constructed and describing the black developing device 4Bk as an example, it has a rotatable developing sleeve 4*a*, an applying roller 4*b* for applying the toner to the surface thereof, and an elastic blade 4*c* for regulating the layer thickness of the toner on the surface of the developing sleeve 4*a*, and effects the imparting of charges to and uniform coating of the developing sleeve 4*a* with the one-component non-magnetic negative toner in a toner containing container 4*d*, and such a developing bias that the developing sleeve 4*a* becomes relatively minus is applied to the photosensitive drum 1, whereby the black toner is caused to adhere to the electrostatic latent image on the photosensitive drum 1 to thereby effect reversing development.

The intermediate transferring member 5 is comprised of an intermediate transferring belt 51 as a main constituent member. The intermediate transferring belt 51 is comprised of a flexible belt member having a thickness of 0.5 to 2 mm formed into an endless shape as a base body, and is passed over a drive roller 52, a tension roller (follower roller) 53, an opposing roller 72 for secondary transferring which will be described later, etc., and is rotatively driven in the direction of arrow R5. The intermediate transferring belt 51 is held by and between the aforedescribed photosensitive drum 1 disposed on the surface (outer peripheral surface) side thereof and a primary transferring roller 61 to be described which is disposed on the back (inner peripheral surface) side thereof, and between the surface of the intermediate transferring belt 51 and the surface of the photosensitive drum 1, a primary transferring nip portion (a first transferring position) $N_1$ is formed along the of the photosensitive drum 1.

The first transferring means 6 which is a voltage applying means is provided with a primary transferring roller 61 disposed in contact with the back of the intermediate transferring belt 51 and driven rotatingly in direction R61 (FIG. 7) at a position opposed to the photosensitive drum 1, and a primary transferring bias voltage source 62 for applying a primary transferring bias thereto. The black toner image formed on the photosensitive drum 1 is primary-transferred onto the intermediate transferring belt 51 by a primary transferring bias of the order of +300 to +500 V being applied to the primary transferring roller 61 by the primary transferring bias voltage source 62. After the primary transferring, the photosensitive drum 1 has any residual toner of primary transferring remaining on its surface removed by a cleaner 8, and is used for the next formation of a yellow image.

The above-described series of image forming processes comprising charging, exposure, development, primary transferring and cleaning are successively carried out with respect also to yellow, magenta and cyan, whereby toner images of four colors are formed in superposed relationship with one another on the intermediate transferring belt 51. At this time, the primary transferring bias is sequentially increased, for example, like +400 V, +600 V, +700 V and +800 V, in the order of black (first color), yellow (second color), magenta (third color) and cyan (fourth color).

The second transferring means 7 is provided with a secondary transferring roller 71 disposed on the surface side of the intermediate transferring belt 51, and an opposing roller 72 for secondary transferring disposed on the back side of the intermediate transferring belt 51, and the intermediate transferring belt 51 is held by and between these two rollers 71 and 72, and a secondary transferring nip portion (a second transferring position) $N_2$ is constituted between the surface of the secondary transferring roller 71 and the intermediate transferring belt 51. The secondary transferring roller 71 is disposed for movement in the direction of arrow K7, and has connected thereto a secondary transferring bias voltage source 73 for applying a secondary transferring bias thereto. Also, the opposing roller 72 for secondary transferring is in a floating state. The toner images of four colors primary-transferred onto the intermediate transferring belt 51 are collectively secondary-transferred onto a transfer material P such as paper by the secondary transferring bias being applied to the secondary transferring roller 71 by the secondary transferring bias voltage source 73.

After the secondary transferring, the intermediate transferring belt 51 has any uncollected residual toner of secondary transferring on its surface removed by cleaning means 95 having a fur brush 96 (or a blade or the like), and thereafter any residual charges remaining on the surface thereof are removed by charge removing means 9. The charge removing means 9 has a charge removing roller 91, a housing 92 movable in the direction of arrow K9, and an auxiliary roller 93 disposed in opposed relationship with the housing 92 with the intermediate transferring belt 51 interposed therebetween. With the cleaning means 95, the housing 92 is moved in the direction of arrow K9 to thereby bring the intermediate transferring belt 51 between the charge removing roller 91 and the auxiliary roller 93, and a predetermined bias voltage is applied thereto by a bias voltage source 94 to thereby remove any residual toner of secondary transferring and any residual charges on the surface of the intermediate transferring belt 51, thus initializing the intermediate transferring belt. It is one of the effects of using low resistance rubber for the base layer of the intermediate transferring belt 51 as will be described later that the above-described charge removing becomes possible by contact charging means which is non-corona charging.

On the other hand, the transfer material P onto which the toner images of four colors have been secondary-transferred by the second transferring means 7 is heated and pressed by a fixing device (not shown) and has the toner images fixated on its surface, whereafter it is discharged out of the image forming apparatus body.

In the above-described image forming process, the process speed $v_p$ (the peripheral speed of the photosensitive drum 1) is set to $v_p$=10.0 cm/sec., and the transfer material P is adapted to be fed in the direction of arrow Kp by transfer material conveying means (not shown).

Description will now be made of the intermediate transferring member 5, the second transferring means 7 and the charge removing means 9.

Figure 2A:
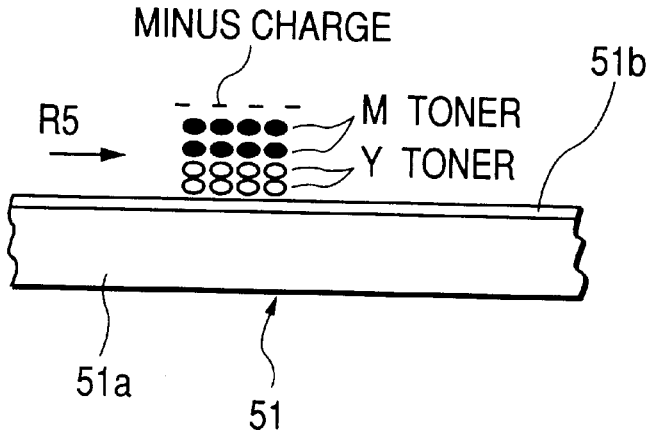
FIGS. 2A and 2B are illustrations showing the manner in which toners on an intermediate transferring belt scatter.
Figure 2B:
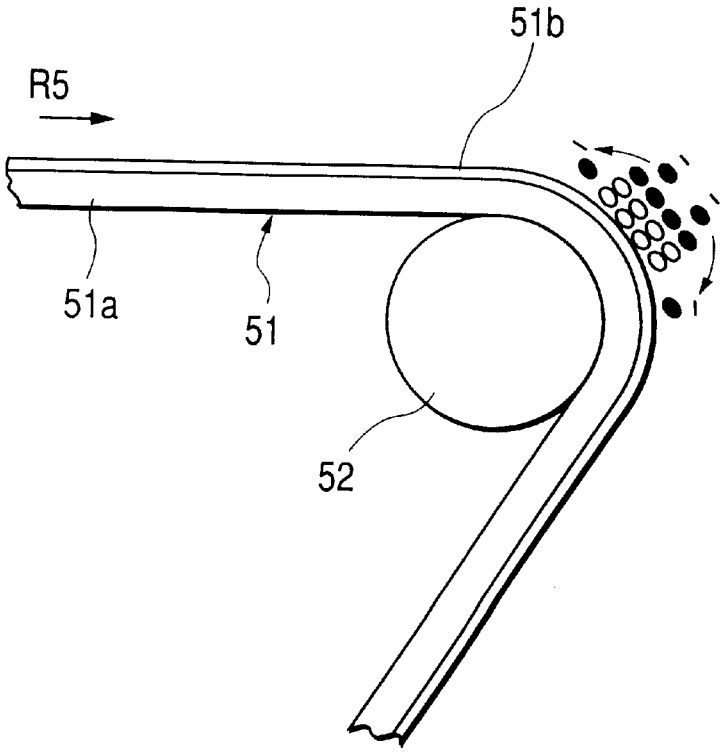

The intermediate transferring belt 51 is comprised of a coat layer (surface layer) 51*b* as a cover layer provided on a base layer (lower layer) 51*a* as shown in FIGS. 2A and 2B, and as the base layer 51*a*, use was made of one which was formed of a material such as NBR (nitrile rubber) or EPDM (ethylene propylene rubber) of which the volume resistivity was adjusted to the order of $1\times10^4$ Ω.cm by the addition of carbon, titanium oxide, tin oxide or the like and the hardness was nearly 60 degrees according to JIS-A measuring method and which was seamlessly molded into a cylindrical shape having a thickness of 1 mm, a width of 220 mm and a circumference of about 140 πmm. As the molding method, for example, a wadding for reinforcement was sandwiched between two sheets of extrusion-molded rubber materials, and they were vulcanized, whereby there could be obtained a base layer 51*a* of high strength suffering little from expansion and contraction.

The base layer is preferable to have thickness of 0.5 to 2 mm, and volume resistivity of $10^2$ to $10^8$ Ω.cm.

As the coat layer 51*b* of high resistance provided on the base layer 51*a*, use was made of one comprising a parting agent such as Teflon dispersed in a binder of the urethane origin, and coating was effected so that the thickness thereof might be about 50 μm. As the coating method, use can be made of spray coating, dipping or other methods. The resistance value of the coat material of the coat layer 51*b* used was about $10^{12}$ to $10^{16}$ Ω.cm selected as volume resistivity from among urethane materials. At this time, the volume resistivity of the whole (the direction of thickness) of the intermediate transferring belt 51 is about $10^{12}$ to $10^{16}$ Ω.cm.

By using a coat material of such volume resistivity, the charging alleviating or attenuating time period of the intermediate transferring belt 51 from when the belt is charged in a predetermined potential V to the potential is reduced to V/e (e is the base of a natural logarithm can be made into a good value, so that the wall of potential which will be described later can be formed well on the intermediate transferring belt 51.

Description will now be made of a method of measuring the volume resistivity of the coat layer 51*b*. First, an electrically conductive plate of aluminum or the like having a predetermined size is coated with a coat material. This was vertically sandwiched by a high resistance meter 8340A (the diameter of a probe electrode being 50 mm, the inner diameter of a guard electrode being 70 mm/the outer diameter being 80 mm, and an opposed electrode used being based upon JIS-K6911) produced by Advantest Co. Ltd., and was measured with a voltage of 100 V applied thereto, whereby the volume resistivity thereof was found.

The second transferring means 7 will now be described.

As the secondary transferring roller 71 in the second transferring means 7, use was made of a rubber roller of foamed EPDM having hardness of about 40 degrees (by Ascar C measuring method) and volume resistivity of about $10^4$ Ω.cm. Besides this, use may be made of rubber of the urethane origin of low resistance, chloroprene rubber, NBR or the like. Also, a voltage of about +1000 to +2000 V was applied to the secondary transferring bias voltage source 73 so that a transferring current of the order of 10 μA might flow during the supply of paper.

The charge removing means 9, used as the charge removing roller 91, includes a roller of a material similar to that of the charging roller 21. The charging roller 21 is one by the well-known contact charging system, and is constituted by providing a medium resistance layer having a thickness of 100 to 200 μm and volume resistivity of the order of $10^6$ Ω.cm, for example, on elastic electrically conductive rubber having a thickness of the order of 3 mm, and further providing thereon a securement preventing layer (resin of the nylon origin) having a thickness of several tens of μm. As the charge removing voltage, a bias voltage comprising a DC voltage of the order of +100 to +1000 V superposed on an AC voltage of which the peak-to-peak voltage $V_{pp}$ was about 3 kV was applied by the bias voltage source 94, and the opposed auxiliary roller 93 was brought to the same potential as the primary transferring roller 61.

Description will now be made of the developers used in the first embodiment.

As the developers, non-magnetic one-component negative toners using resin of the polyester origin as the parent body were used for all colors Bk, Y, M and C. Taking an example with respect to their details, it is a toner characterized in that the binding resin of the toner contains as a main component polyester resin produced from a monomeric composition containing at least the following components (a), (b), (c) and (d), the hydroxyl value of this polyester resin is 10 to 20 and the weight average molecular weight thereof is 13000 to 20000, and the number average molecular weight thereof is 5000 to 80000, and the ratio of weight average molecular weight (Mm)/number average molecular weight (Mn) is 2 to 3.5.

(a) A divalent aromatic acid component chosen from isophthalic acid, terephthalic acid and the derivatives thereof amounting to 25 to 30 mol % of the total quantity of monomer;

(b) A trivalent aromatic acid component chosen from trimellitic acid and the derivatives thereof amounting to 2 to 4 mol % of the total quantity of monomer;

(c) A divalent acid component at least chosen from dodecenyl succinic acid, octyl succinic acid and the anhydrides thereof amounting to 12 to 18 mol % of the total quantity of monomer; and (d) Propoxized or/and ethoxized etherificated diphenol component amounting to 45 to 60 mol % of the total quantity of monomer.

The above-mentioned toner parent body was suitably colored by coloring agents, and crushed and classified into a diameter of about 7 $\mu$m, and thereafter a charging control agent was extraneously added thereto to thereby manufacture black, yellow, magenta and cyan toners. When the amount of charge of each of the above-described toners was measured by sucking it from the developing sleeve 4*a*, it was nearly 20 to 30 $\mu$q/g. Also, when the amount of toner in the solid image of each color on the transfer material P was measured, it was of the order of 0.6 to 0.7 mg/cm$^2$.

Under the conditions as described above, two of Y toner, M toner and C toner which are color toners were superposed one upon the other to thereby make a color character, and the evaluation of scatter was effected. The mechanism of the scatter of characters and lines by the superposition of colors will now be described with reference to FIGS. 2A and 2B.

As shown in FIG. 2A, when as an example, a red character is to be formed by toners, toners are laminated in the order of Y and M on the intermediate transferring belt 51 by primary transferring. The intermediate transferring belt 51 effects at least four rotations to form a full color image and therefore passes the portions of the rollers 52, 72 and 53 of FIG. 1 a plurality of times, and is subjected to curving and expansion and contraction of its surface (in the curved portion, as compared with the straight portion, the surface of the belt expands and the back thereof contracts). At this time, M toner riding on the upper layer of Y toner is subjected to the curving and expanding and contracting shocks of the intermediate transferring belt 51 while being subjected to the electrical repulsion from Y toner and therefore, the scatter of M toner occurs as shown in FIG. 2B.

Figure 3A:
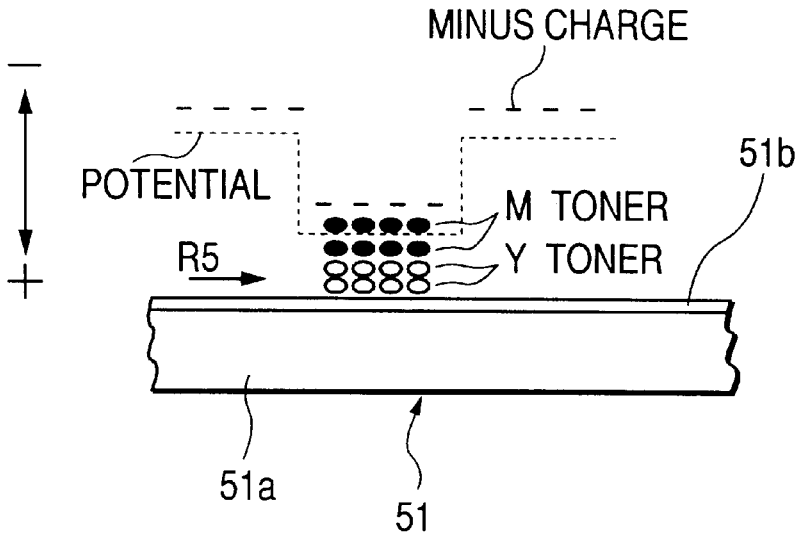
FIGS. 3A and 3B are illustrations showing the manner in which the scatter of the toners on the intermediate transferring belt is suppressed.
Figure 3B:
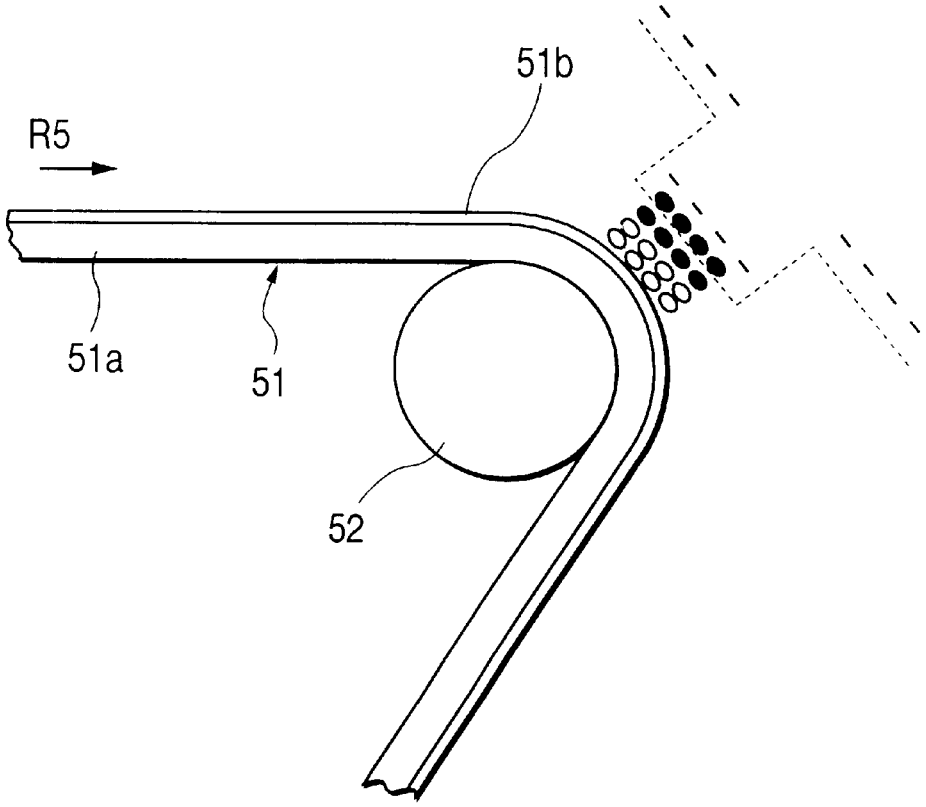

In contrast, as shown in FIGS. 3A and 3B, minus charges which shifted onto the intermediate transferring belt 51 during the primary transferring from the photosensitive drum 1 form a wall of potential, whereby the above-mentioned scatter is suppressed. Describing in greater detail, as in the present first embodiment, in the reverse developing system, the potential of the background portion (dark potential) on the photosensitive drum 1 is greater in the minus direction than the potential of the toner portion (light potential), whereby in an area wherein there is no toner during primary transferring (plus polarity), more minus charges than in an area wherein there are toners shift onto the intermediate transferring belt 51, and a wall of potential is formed as shown in FIG. 3A. By this wall, M toner (minus charge) on Y toner is suppressed from scattering to around.

Accordingly, this phenomenon of scatter appears more remarkably as the diameters of the rollers 52, 53, 72, inside the intermediate transferring belt 51 become smaller (in the present first embodiment, the diameters of the rollers 52, 53 and 72 are 30 mm, 16 mm and 30 mm, respectively).

Also, the shocks during the above-described curving and expansion and contraction of the intermediate transferring belt 51 are affected by the thickness of the base layer 51*a* of the intermediate transferring belt 51, and a greater thickness is more disadvantageous.

Further, if the resistance value of the intermediate transferring belt 51 is too low, the holding of the above-mentioned charges is impossible and therefore, scatter is aggravated. To make the above-mentioned wall of potential great, the primary transferring voltage can be made great, but if this voltage is too great, there will arise inconveniences such as the disturbance of image and the reduced efficiency of primary transferring by the discharge of electricity in air at the primary transferring nip portion $N_1$.

FIG. 4 shows the results of the scatter of the toners by the above-described mechanism, and more particularly, the results of the scatter of red, blue and green characters when as in this first embodiment, primary transferring was effected in the order of Bk (black)→Y (yellow)→M (magenta)→C (cyan) and when as in the example of the prior art, primary transferring was effected in the order of Y→M→C→Bk. As shown in FIG. 4, as compared with the example of the prior art, in the first embodiment, the scatter of color characters is greatly improved. That is, in the example of the prior art, when a red character is taken as an example, M toner is superposed on Y toner, whereafter the intermediate transferring belt 51 must be rotated about twice and in the meantime, M toner on Y toner scatters little by little at each point of bend as shown in FIG. 2B, whereas in the first embodiment, after M toner is superposed on Y toner, the intermediate transferring belt 51 can be rotated only once and therefore, the scatter can be decreased. Particularly, with regard to blue and green characters, after C toner is superposed on M toner and after C toner is superposed on Y toner, they are substantially only subjected to the bending by the drive roller 52 and are immediately secondary-transferred to the transfer material P and therefore, the scatter can be prevented very well. In the first embodiment, the first color is black toner, but generally, black toner is only used as monochromatic black characters or a small amount of inking (UCR processing) on color images (color characters and color lines) and therefore is not used in a great deal for color characters and color lines and therefore, the scatter of color toners superposed on black toner poses practically no problem. Therefore, evaluation was omitted regarding the superposition of color toners on black toner.

Also, in the above-described evaluation using FIG. 4, the amount of printing of the toner of each color was 100% and during the superposition of two colors, printing at 200% was used, but in a full color printer for multivalue images having a medium tone, besides the above-mentioned UCR processing, it is preferable that the amount of toner be adjusted so as to be 80% to 100% for each color in order to adjust the hue by the masking process or the like when R (red), G (green) and B (blue) signals are converted into Y, M, C and Bk signals, that is, so as to be 160% to 200% when two of Y toner, M toner and C toner are superposed one upon the other, and the actual scatter level can generally be somewhat improved more than the result shown in FIG. 4, but of course, it affects the effectiveness of the present invention in no way.

Description will now be made of the relations among the diameters and angles of twining of the rollers 52, 53 and 72 over which the intermediate transferring belt 51 is passed and the scatter of color characters in the present embodiment. In the first embodiment, as previously described, the diameters of the rollers 52, 53 and 72 are 30 mm, 16 mm and 30 mm, respectively, and the angles of twining of the intermediate transferring belt 51 onto the rollers 52, 53 and 72 are nearly 155°, 95° and 110°, respectively, and in contrast, it is known that the smaller are the diameters of the respective rollers, i.e., the radii of curvature, and the greater are the angles of twining, the more aggravated is the scatter.

So, with the diameters of the rollers 52, 53 and 72 in the first embodiment as the standards, the diameters of the rollers 52, 53 and 72 were changed independently of one another and changes in the scatter were examined. The results of this is shown in FIG. 5. This result differs among red, blue and green because the frequency of passage of the roller portions differs from color to color, but the aforedescribed tendency of scatter is the same. So, in order to know the mutual influences of the diameters and angles of twining of the rollers 52, 53 and 72, the diameters of the rollers were defined as R mm and the angles of twining of the rollers were defined as θ degrees, and $\alpha=R\times360/\theta$ was written together.

As the result, it has been found that in the first embodiment, by α being $\alpha\geqq55$, it is possible to suppresses the scatter within a practically allowable range. Generally, larger diameters R are advantageous to the scatter of toners on the belt by the bending of the intermediate transferring belt 51, but the image forming apparatus becomes corresponding bulky. In contrast, in the first embodiment, α may be $\alpha\geqq55$ for the prevention of the scatter and therefore, by making θ small without making R great, the above-described condition can be satisfied and therefore, it becomes unnecessary to make the image forming apparatus bulky.

<Second Embodiment>

Figure 6:
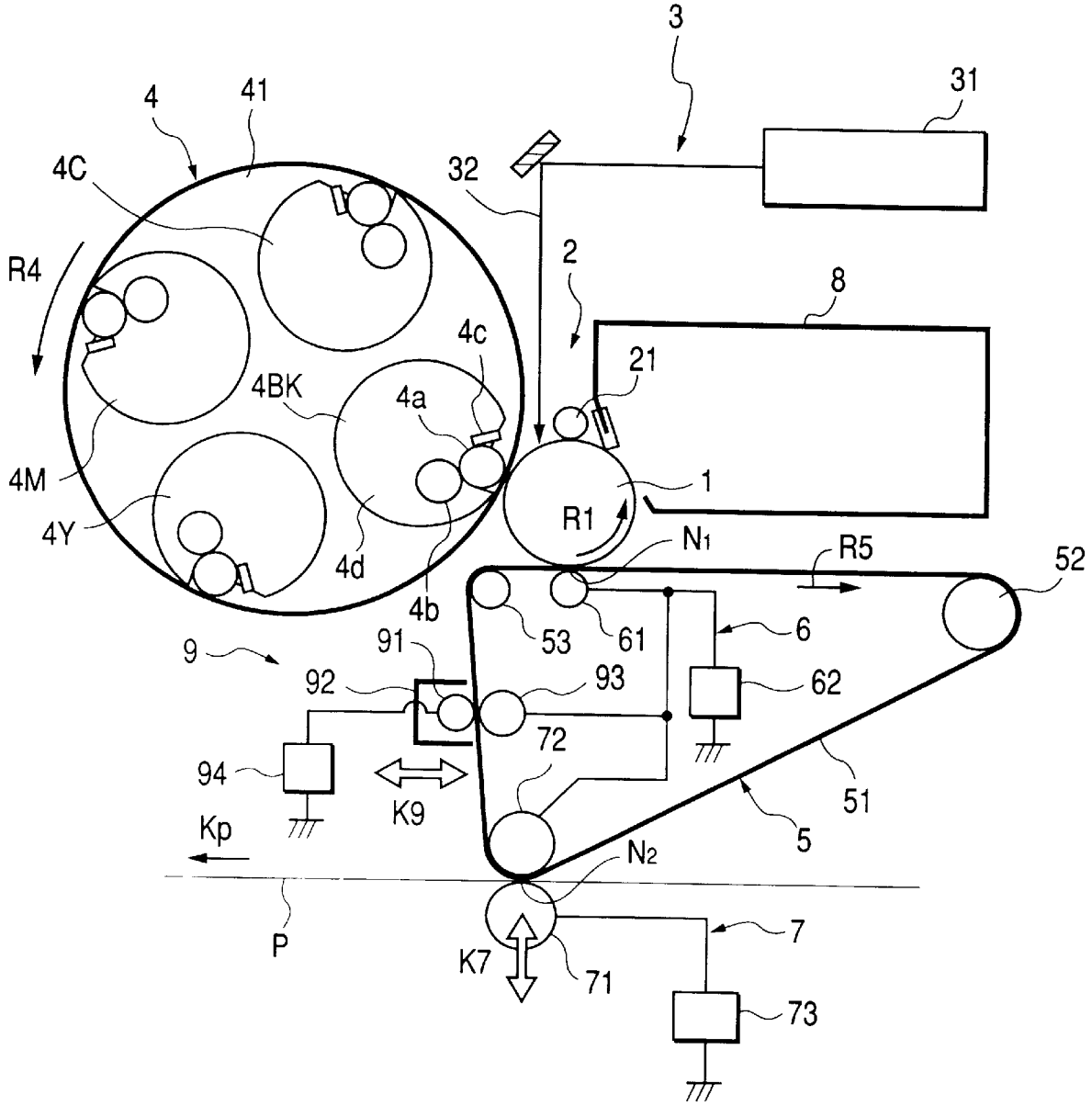
FIG. 6 schematically shows the construction of an image forming apparatus according to a second embodiment of the present invention.

FIG. 6 shows a second embodiment of the present invention.

An image forming apparatus shown in FIG. 6 eliminates the cleaning means 95 for the intermediate transferring belt 51 in the first embodiment and instead of this, charging means 9 is used to charge the residual toner of secondary transferring on the intermediate transferring belt 51 after secondary transferring to a polarity (in the present embodiment, the plus polarity) opposite to the regular charging polarity of the toners in the developing means 4, thereby collecting it onto the photosensitive drum 1.

In order that the collection may take place effectively, an AC bias (of the order of 2 to 3 $kV_{pp}$ and 1 to 3 kHz) and a DC bias (a bias of the order of 0 to 500 V relative to the value of the secondary transferring bias applied to the opposing roller 93) for charging the residual toner of secondary transferring to the plus polarity may be applied in superposed relationship with each other as the voltage of the bias voltage source 94 applied to the charge removing roller 91.

Figure 7:
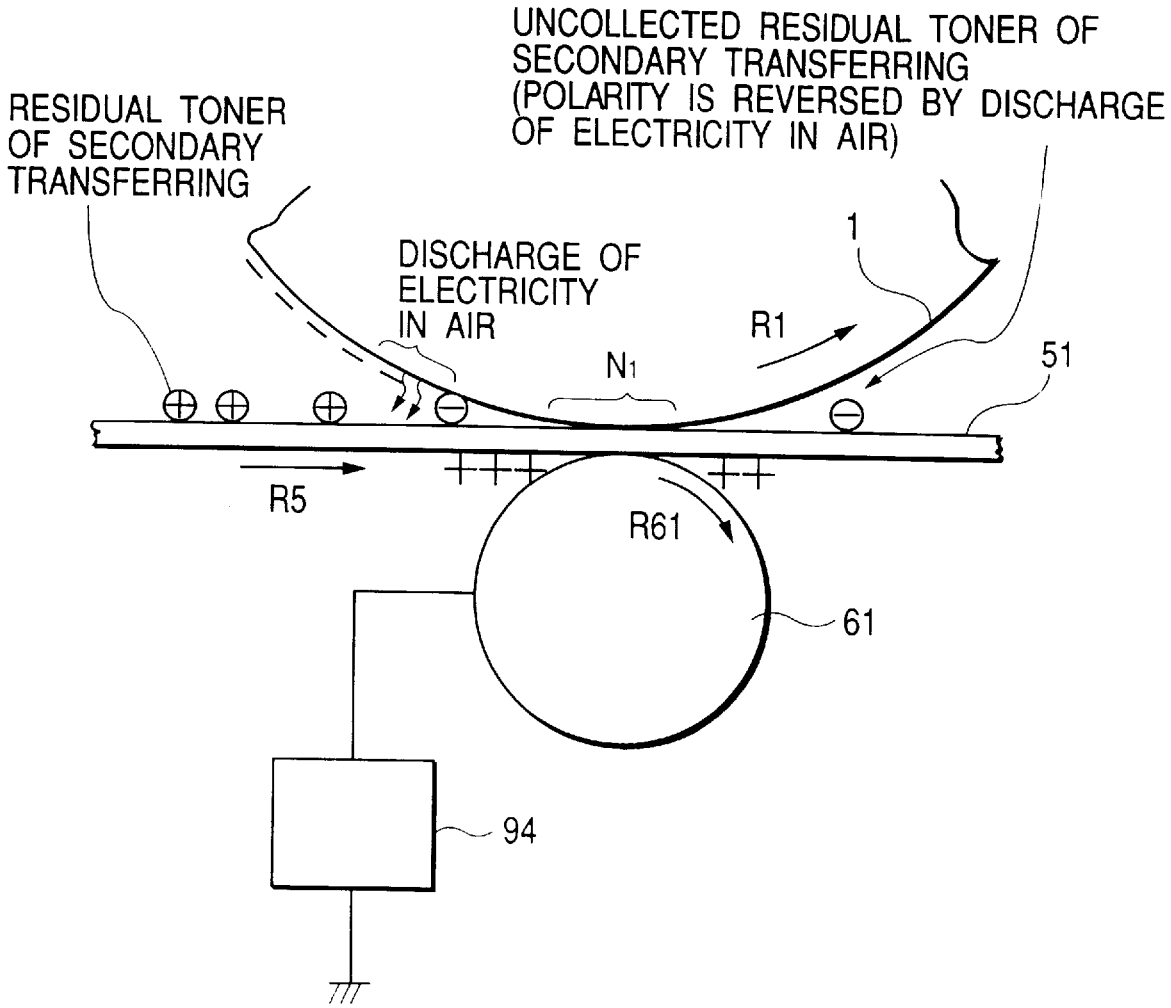
FIG. 7 illustrates a state in which the collection of residual toner of secondary transferring is bad in the second embodiment.

On the other hand, in order that the residual toner of secondary transferring charged to the plus polarity may be collected onto the photosensitive drum 1, it is necessary that the relation between the surface potential of the photosensitive drum 1 and the bias voltage value of the primary transferring roller 61 be within a predetermined range. Specifically, in the construction of the second embodiment, in order that the toners charged to the plus polarity may be collected onto the photosensitive drum 1 charged to the minus polarity, when the surface potential of the photosensitive drum 1 is $V_S$ (V) and the primary transferring bias value is $V_{T1}$ (V), it is preferable that $$\Delta V=V_S-V_{T1}$$

be within the range of −200 to −800 V. That is, if the absolute value of ΔV is smaller than 200 V, the plus toners will not be attracted to the photosensitive drum 1, and if conversely, the absolute value of ΔV is greater than 800 V, as shown in FIG. 7, on this side of the vicinity of the nip (the upstream side with respect to the direction of rotation of the intermediate transferring belt 51) made by the photosensitive drum 1 and the intermediate transferring belt 51 at the primary transferring nip portion $N_1$, the discharge of electricity in air will occur between the photosensitive drum 1 and the intermediate transferring belt 51 and as the result, immediately before primary transferring, the intermediate transferring belt 51 and the residual toner of secondary transferring thereon will be charged to the minus polarity and therefore, the residual toner of secondary transferring will not be collected onto the photosensitive drum 1.

As regards the surface potential $V_S$ of the photosensitive drum 1, in the second embodiment, the dark portion is at nearly −600 V and the light portion is at nearly −100 V and therefore, to satisfy the condition for cleaning as described above, when the primary transferring of the first color for the next printing is to be effected simultaneously with cleaning, the primary transferring bias value for this first color must be within the range of +100 to +200 V (if it is smaller than +100 V, the residual toner of secondary transferring will not be collected onto the light portion, and if it is greater than +200 V, the discharge of electricity in air will occur to the dark portion and the residual toner of secondary transferring will not be collected).

To collect the residual toner of secondary transferring simultaneously with primary transferring as described above, a condition imposed on the primary transferring of the first color becomes severe. However, as described in the aforedescribed first embodiment with reference to FIGS. 2A, 2B, 3A and 3B, to prevent the scatter of superposed color characters, it is necessary to form a wall of potential as shown in FIG. 3A and therefore, in the order of colors Y→M→C→Bk, the primary transferring bias value of the first color, yellow, must be of the order of +400 V or greater, and it is difficult to effect the removal of the residual toner of secondary transferring wall simultaneously with primary transferring by the construction as shown in FIG. 6.

On the other hand, in the present embodiment, Bk (black) is the first color in such a manner that the order of colors of primary transferring is Bk→Y→M→C and therefore, for the reason that color-superposed characters in which black and other colors are superposed one upon another by the order of 100% do not actually exist, it is not necessary to pre-form the wall of potential as shown in FIG. 3A in the first color and accordingly, it becomes possible to reduce the transferring bias value for the first color to the range of +100 to +200 V (this value is a value entirely free of problems in the present embodiment).

When the scatter was compared among red, blue and green color characters with +150 V, +500 V, +650 V and +800 V used as the values of the primary transferring bias in the order of the first color (Bk), the second color (Y), the third color (M) and the fourth color (C), there was obtained a good result entirely similar to the result obtained in the first embodiment (see FIG. 4). Further, the transferring bias value of the first color is +150 V and therefore, the construction of the image forming apparatus of FIG. 6 can be assumed without the scatter being aggravated, and so-called cleaning simultaneous with primary transferring in which the residual toner of secondary transferring is collected onto the photosensitive drum 1 during the primary transferring of the next print becomes possible, and the great simplification of the image forming apparatus and the improved throughput of image formation become possible.

<Third Embodiment>

Figure 8:
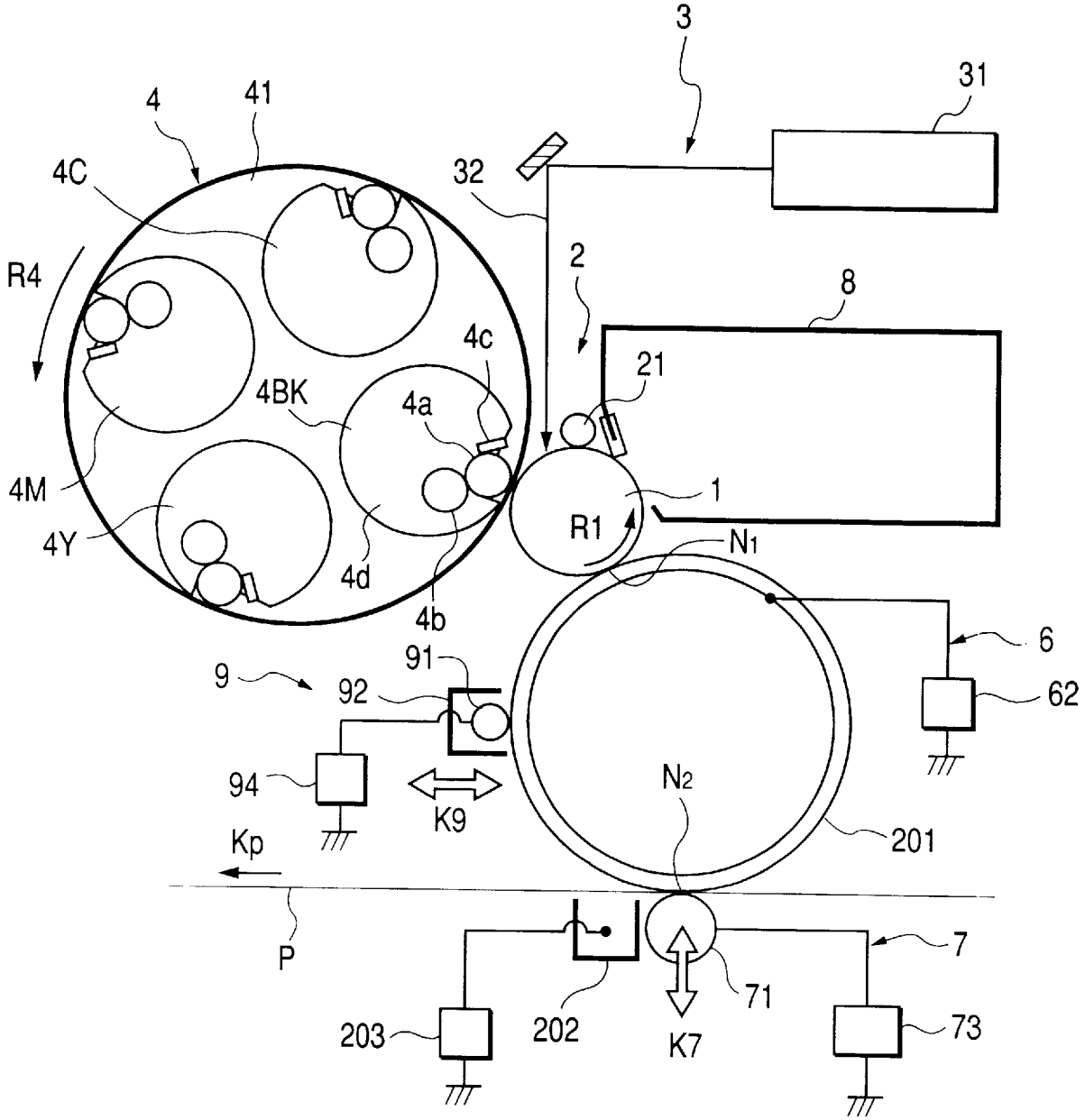
FIG. 8 schematically shows the construction of an image forming apparatus according to a third embodiment of the present invention.

FIG. 8 shows a third embodiment of the present invention.

In the third embodiment shown in FIG. 8, an intermediate transferring drum 201 is used instead of the intermediate transferring belt 51 in the aforedescribed second embodiment. The intermediate transferring drum 201 is functionally similar to the intermediate transferring belt 51 described in the first embodiment and accordingly, the construction of the image forming apparatus according to the present embodiment is entirely similar to that described previously, except for the intermediate transferring drum 201 and therefore, detailed description is omitted here, and only the intermediate transferring drum 201 and a separating charger 202 will be described below. In FIG. 8, members functionally similar to those in the aforedescribed embodiments are given similar reference numerals.

Figure 9:
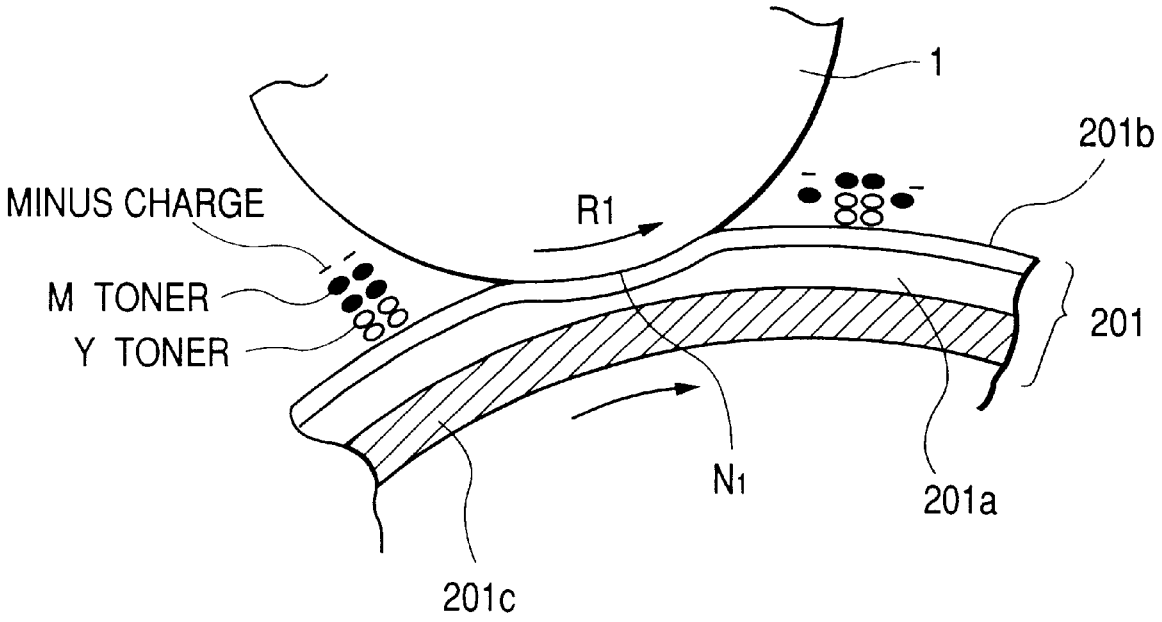
FIG. 9 illustrates a state in which scatter occurs in the third embodiment.

As shown in FIG. 9, the intermediate transferring drum 201 is comprised of a base layer 201*a* provided on a metallic cylindrical member 201*c*, and a coat layer 201*b* provided thereon. As the base layer 201*a*, use was made of a material such as NBR (nitrile rubber) or EPDM (ethylene propylene rubber) having had its volume resistivity adjusted to the order of $1\times10^4$ Ω.cm by the addition of carbon, titanium oxide, tin oxide or the like and having hardness of the order of 35 to 40 degrees by JIS-A measuring method, and it was molded on the metallic cylindrical member 201*c* so as to have a thickness of 5 mm, a width of 220 mm and an outer diameter of 140 mm.

As the coat layer 201*b* of high resistance provided on the base layer 201*a*, use was made of a parting agent such as freon dispersed in a binder of the urethane origin, and coating was done so that the thickness thereof might be of the order of 50 μm. As the coating method, use can be made of spray coating, dipping or other methods. As regards the resistance value of the coat material of the coat layer 201*b*, a material having volume resistivity of the order of $10^{12}$ to $10^{16}$ Ω.cm was chosen from among urethane materials.

A primary transferring bias voltage source 62 (see FIG. 8) as voltage applying means is connected to the metallic cylindrical member 201*c* of the above-described intermediate transferring drum 201, but this is entirely the same in function as the primary transferring bias voltage source described in the first embodiment, and therefore need not be described. Also, secondary transferring means 7 and charge removing means 9 are entirely the same in function as those described in the first embodiment and the second embodiment and therefore need not be described.

The separating charger 202 will now be described.

The separating charger 202 is a corona charger for separating a transfer material P adsorbed to the intermediate transferring drum 201, and the higher is the resistance of the coat layer 201*b* and the larger is the diameter of the intermediate transferring drum 201, the greater becomes the degree of adsorption. In this third embodiment, an AC high voltage of 9 $kV_{pp}$ and 500 Hz and a DC high voltage of the order of −500 to −2000 V are applied to the separating charger 202 in superposed relationship with each other by a bias voltage source 203 to thereby effect electrostatic separation.

The mechanism by which the scatter of color-superposed characters occurs on the intermediate transferring drum 201 will now be described with reference to FIG. 9.

First, the intermediate transferring drum 201 is caused to bear against the photosensitive drum 1 with line pressure of nearly 500 g/cm, and a primary transferring nip portion $N_1$ is formed in along the surface of the photosensitive drum 1. At this time, as shown in FIG. 9, the base layer 201*a* is deformed at the primary transferring nip portion $N_1$ and therefore, the surface layer 201*b* is deformed into convex→concave→convex shapes before and behind the primary transferring nip portion $N_1$. As the result, when plural times of idle rotation is effected after a color-superposed character (red=Y+M as the example of FIG. 9) is formed on the intermediate transferring drum 201, the upper toner (M toner in FIG. 9) gradually scatters. The greater is the bearing pressure of the intermediate transferring drum 201 against the photosensitive drum 1 and the lower is the hardness of the intermediate transferring drum 201 (in the third embodiment, the hardness of the base layer 201*a*), the more aggravated is the degree of this scatter. When the above-mentioned bearing pressure is too small, primary transferring becomes unstable or the bearing state changes delicately and color misregistration occurs during the color superposition during primary transferring. Also, if the hardness of the intermediate transferring drum 201 is too high, inner hollowness becomes liable to occur in characters and thin lines. According to the result of the applicant's studies, as the bearing pressure between the photosensitive drum 1 and the intermediate transferring drum 201 and the hardness of the base layer rubber, line pressure of the order of 100 to 1000 g/cm and the order of 30 to 40 degrees by JIS-A measuring method (as the hardness of the product including the surface layer 201*b*, the order of 55 to 65 degrees of JIS-A measuring method) were good values against the primary transferring property, color misregistration, inner hollowness, etc.

So, when actually in the above-described construction of the image forming apparatus, the scatter of color-superposed characters was confirmed in the order of color Y→M→C→Bk as in the prior art, scatter similar to that described in the first embodiment occurred in color-superposed characters (in the heretofore known multiplex transferring system, i.e., a system in which a transfer material is held on a cylindrical support member and toner images are successively transferred repetitively from a photosensitive drum, the bearing pressure between the transfer material and the photosensitive drum is sufficiently low and the scatter as described above does not occur during the idle rotation after the formation of color-superposed characters).

So, when image formation was done in the order of colors Bk→M→C→Y, the scatter of color characters could be improved as shown in FIG. 10. It seems to owe to the characteristic of the intermediate transferring drum 201 used in the present embodiment that the scatter level of the example of the prior art is improved more in the third embodiment than in the first embodiment of FIG. 4.

<Fourth Embodiment>

In the aforedescribed first to third embodiments, description has been made of forming a black toner image on the intermediate transferring member (the intermediate transferring belt 51 or the intermediate transferring drum 201). On the other hand, the scatter on the intermediate transferring member during color superposition is also greatly affected by the degree to which the scatter in the visual effect is recognized, discretely from the actual amount of scatter. In this case, as regards the scatter on the intermediate transferring member, the colors superposed upwardly on the intermediate transferring member chiefly scatter and thus, when color superposition is done in the order of Bk→Y→M→C as in the first to third embodiments, magenta, cyan and cyan scatter in the case of red characters, blue characters and green characters, respectively. However, on the transfer material P, the vertical relations among the toners of respective colors change places at the secondary transferring nip portion $N_2$ and therefore, yellow becomes the outermost surface layer for red characters, magenta becomes the outermost surface layer for blue characters, and yellow becomes the outermost surface layer for green characters and finally, on the transfer material P, an image is formed with the toner in the lower layer scattered.

When thus, there is much scatter of the toners like magenta and cyan which are felt to be visually dark, more scatter than actually is felt. In other words, scatter can be visually improved by forming toners of colors which are felt to be visually thin as the upper layer (the lower layer on the transfer material P) on the intermediate transferring member, whereby it becomes possible to visually improve the scatter.

Specifically, it follows that primary transferring can be effected to magenta or cyan with yellow toner low in visibility as the final color.

FIG. 11 shows the result of the evaluation of the scatter when color characters were formed in the order of Bk→M→C→Y. At this time, as the construction of the image forming apparatus, the disposition of the developing devices in FIG. 1 was only changed and all the other conditions were the same as those in the first embodiment.

According to the result shown in FIG. 11, it is seen that particularly the scatter of red and green are greatly improved. Of course, instead of Bk→M→C→Y, the order of Bk→C→M→Y can also lead to the obtainment of a substantially similar effect. This is because as compared with yellow, both of magenta and cyan toners are equally liable to be visually conspicuous.

Of course, an entirely similar effect will be obtained even if the above-mentioned order of colors is applied to the image forming apparatus according to the second embodiment. Also, a similar effect will of course be obtained in the intermediate transferring drum 201 described in the third embodiment.

<Fifth Embodiment>

Figure 12:
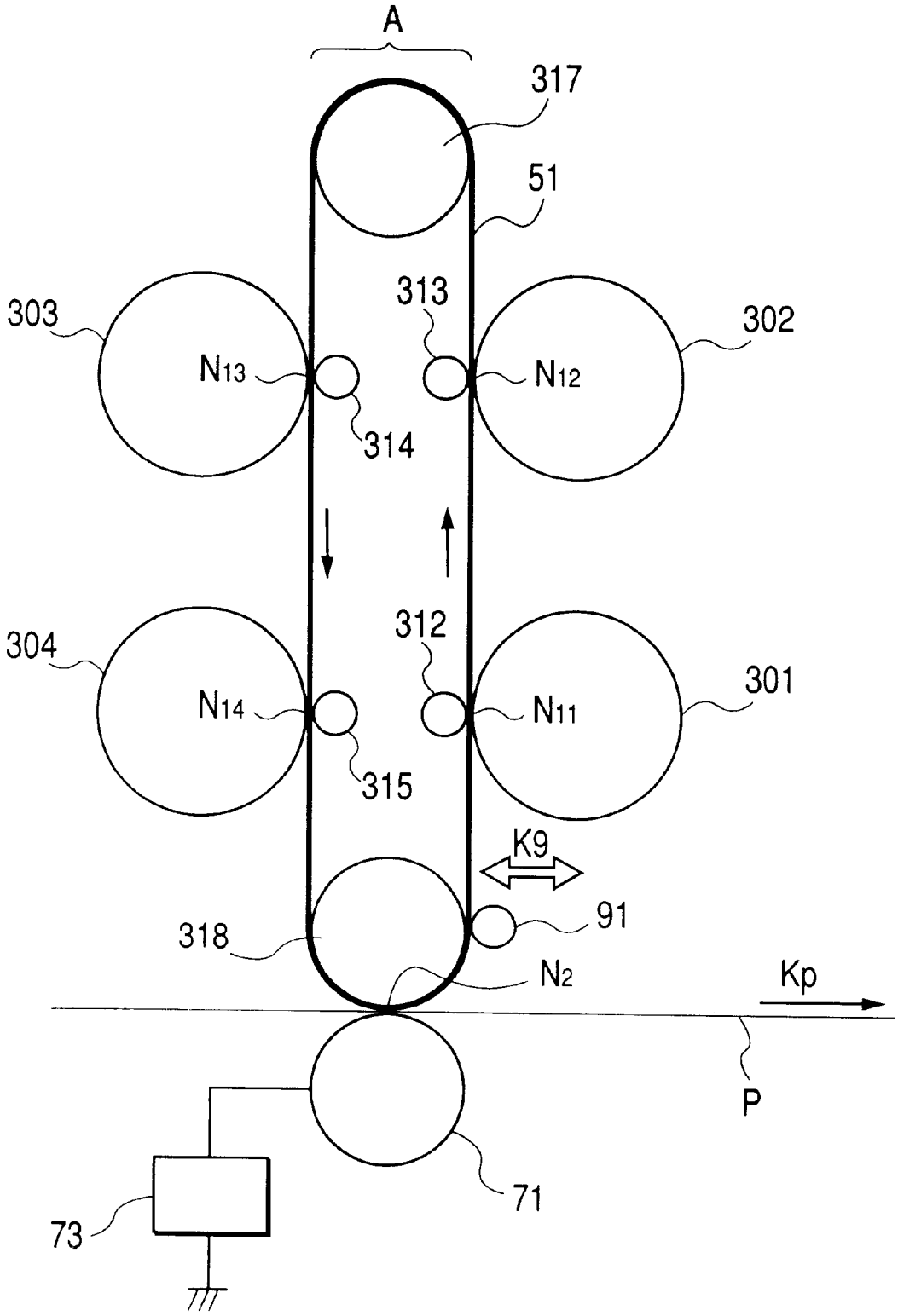
FIG. 12 schematically shows the construction of an image forming apparatus according to a fifth embodiment of the present invention.
Figure 13:
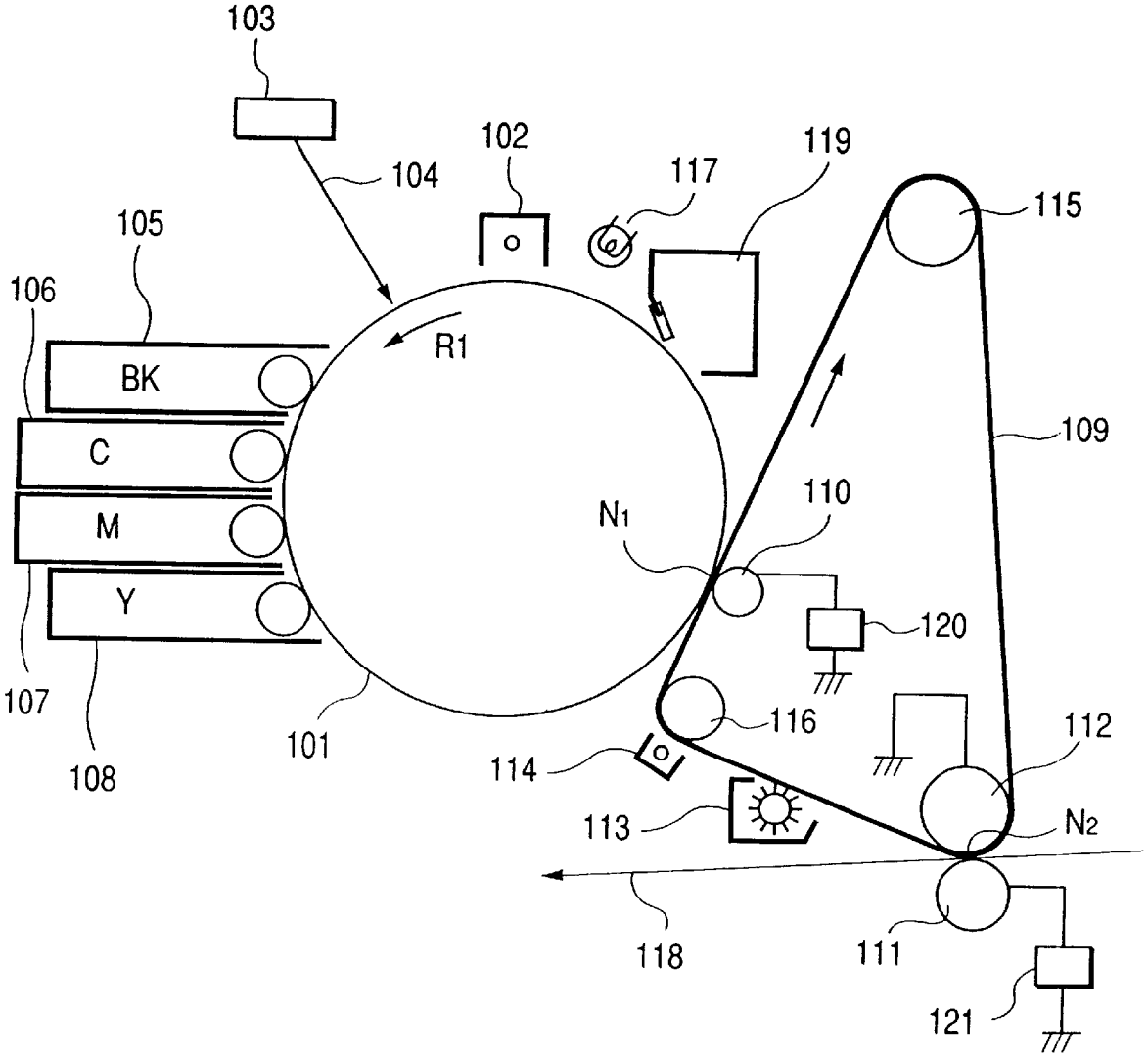
FIG. 13 PRIOR ART
FIG. 13 schematically shows the construction of an image forming apparatus according to the prior art.
Figure 14:
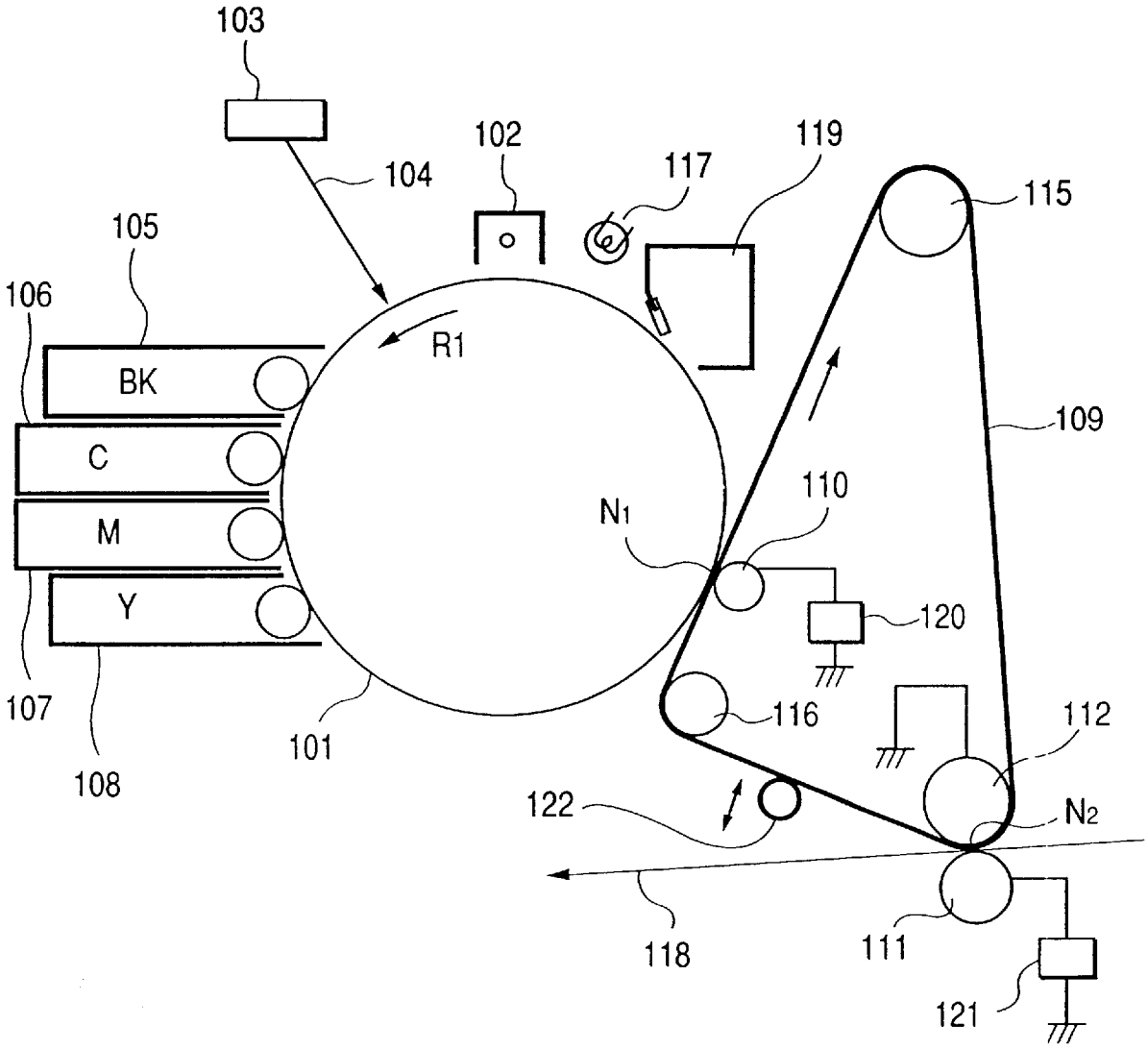
FIG. 14 PRIOR ART
FIG. 14 schematically shows the construction of an image forming apparatus according to the prior art.

In a fifth embodiment of the present invention, as shown in FIG. 12, photosensitive drums 301, 302, 303 and 304 corresponding to Bk, Y, M and C, respectively, are installed around an intermediate transferring belt 51 passed over rollers 317 and 318 (the same members as those in the aforedescribed embodiments are given the same reference numerals). By adopting such a construction, the throughput of image formation can be further improved.

A Bk toner image is formed on the photosensitive drum 301 by a developing device, not shown, and the Bk toner image is primary-transferred to the intermediate transfer belt 51 at $N_{11}$ by a primary transferring roller 312 to which a predetermined bias has been applied from a voltage source, not shown. Such primary transferring process is repetitively carried out with respect to Y toner, M toner and C toner, at positions $N_{12}$, $N_{13}$ and $N_{14}$ by primary transferring rollers 313, 314 and 315, respectively, whereby a full color toner image is formed on the intermediate transferring belt 51. This full color toner image is secondary-transferred to a transfer material P at $N_2$ by a secondary transferring roller 71 to which a predetermined bias has been applied from a voltage source 73. The unfixated toner image on this transfer material P is fixated by a fixating device, not shown, and then the transfer material P is discharged out of the apparatus.

When images are to be continuously formed, residual toner of secondary transferring remaining on the intermediate transferring belt 51 after secondary transferring is charged by a charging roller 91 as in the second embodiment and is transferred to the photosensitive drum 301 at $N_{11}$ and at the same time, the next Bk toner on the photosensitive drum 301 is primary transferred at $N_{11}$.

Also, instead of the charging roller 91, cleaning means 95 as in the present embodiment may be used to collect the residual toner of secondary transferring.

The present invention can also be applied to an image forming apparatus of such construction, and the scatter of color lines and color characters can be prevented.

In the present embodiment, a Y toner image is formed before the bent portion A of the intermediate transferring belt 51 (the winding portion of the roller 317), and an M toner image and a C toner image are primary-transferred after the bent portion A (the order of M and C may be converse) and therefore, as compared, for example, with the order of Bk→M→C→Y, this order of colors is also effective for visual scatter.

As described above, according to the present invention, black is used as the first color during primary transferring, whereby the scatter of color characters and color lines during color superposition can be effectively prevented, and the scatter of color characters and color lines can visually be made difficult to see.

Also, the residual toner of secondary transferring on the intermediate transferring member is charged to the polarity opposite to the ordinary developing characteristic, whereby as previously described, the scatter of color characters and color lines during color superposition can be prevented, and yet the removal of the residual toner of secondary transferring can be effected simultaneously with the primary transferring of the next image, and the construction of the image forming apparatus can be simplified and the throughput of image formation when images are continuously formed can be increased.

What is claimed is:

1. A color image forming apparatus comprising:

developing means;

an image bearing member capable of bearing thereon toner images of plural colors formed by said developing means;

a rotatable intermediate transferring member, said intermediate transferring member being provided with a layer having a volume resistivity of $10^{12}$ to $10^{16}$ Ω.cm and for bearing thereon said toner images;

transferring means for electrostatically transferring said toner images of plural colors on said image bearing member to said intermediate transferring member superposedly at a first transferring position; and charging means for charging residual toner remaining on said inter mediate transferring member, after the toner images on said intermediate transferring member transferred by said transferring means are transferred to a transfer material at a second transferring position, to a polarity opposite to a normal charging polarity of the toners in said developing means;

wherein simultaneously with the next first toner image on said image bearing member being transferred to said intermediate transferring member at sa id first transferring position by said transferring means, said residual toner charged by said charging means is transferred to said image bearing member at said first transferring position by said transferring means, and wherein a first toner image transferred from said image bearing member to said intermediate transferring member at said first transferring position by said transferring means is a black toner image.

2. A color image forming apparatus according to claim 1, wherein said base layer member is an elastic layer.

3. A color image forming apparatus according to claim 2, wherein said base layer is a rubber layer.

4. A color image forming apparatus according to claim 1, wherein the charging polarity of said image bearing member and the normal charging polarity of the toners in said developing means are the same.

5. A color image forming apparatus according to claim 1, wherein said intermediate transferring member is provided with a base layer having a volume resistivity of $10^2$ and $10^8$ Ω.cm, and said layer provided on said base layer.

6. A color image forming apparatus according to claim 5, wherein said layer coated on said base layer is a resinous layer.

7. A color image forming apparatus according to claim 1, wherein said intermediate transferring member has a shape of a belt supported by a plurality of rollers.

8. A color image forming apparatus according to claim 7, wherein a following expression is satisfied:

$$R \times 360/\theta \geqq 55$$

where

R: diameters of said rollers (mm), and

θ: contact angles between said rollers and said belt.

9. A color image forming apparatus according to claim 1, 4, 5 or 7, wherein said image bearing member can bear the black toner image, a yellow toner image, a cyan toner image and a magenta toner image.

10. A color image forming apparatus according to claim 9, wherein the last color toner image transferred at said first transferring position from said image bearing member to said intermediate transferring member by said transferring means is the yellow toner image.

11. A color image forming apparatus comprising:

a plurality of image bearing members bearing toner images of plural colors thereon;

a rotatable intermediate transferring member, said intermediate transferring member being provided with a layer having a volume resistivity of $10^{12}$ to $10^{16}$ Ω.cm and for bearing thereon said toner images;

transferring means for transferring said toner images of plural colors on said plurality of image bearing members to said intermediate transferring member sequentially in superposed fashion;

charging means for charging residual toner remaining on said intermediate transferring member, after the toner images of plural colors on said intermediate transferring member are transferred to a transfer material, to a polarity opposite to a normal charging polarity of the toner wherein simultaneously with the next first toner image on said image bearing member being transferred to said intermediate transferring member by said transferring means, said residual toner on said intermediate transferring member is transferred to one of said plurality of image bearing members by said transferring means, wherein the first toner image transferred from the one of said plurality of image bearing members to said intermediate transferring member by said transferring means is a black toner image.

12. A color image forming apparatus according to claim 11, wherein said base layer is an elastic layer.

13. A color image forming apparatus according to claim 12, wherein said base layer is a rubber layer.

14. A color image forming apparatus according to claim 11, further comprising developing means for forming toner images of plural colors on said plurality of image bearing members.

15. A color image forming apparatus according to claim 14, wherein the charging polarity of said plurality of image bearing members and a normal charging polarity of the toners in said developing means are the same.

16. A color image forming apparatus according to claim 11, wherein said intermediate transferring member is provided with a base layer having a volume resistivity of $10^2$ and $10^8$ Ω.cm, and said layer provided on said base layer.

17. A color image forming apparatus according to claim 16, wherein said layer coated on said base layer is a resinous layer.

18. A color image forming apparatus according to any one of claim 11, 14, 15 or 16, wherein said plurality of image bearing members bear a black toner image, a yellow toner image, a cyan toner image and a magenta toner image, respectively, thereon.

19. A color image forming apparatus according to claim 18, wherein said intermediate transferring member is in a shape of a belt supported by a plurality of rollers.

20. A color image forming apparatus according to claim 19, wherein in the direction of rotation of said intermediate transferring member, said yellow toner image is transferred from one of said plurality of image bearing members to said intermediate transferring member after said black toner image is transferred from one of said plurality of image bearing members to said intermediate transferring member and before said black toner image arrives at any of supporting positions by said rollers.

21. A color image forming apparatus according to claim 19, wherein a following expression is satisfied:

$$R \times 360/\theta \geqq 55$$

where

R: diameters of said rollers (mm), and

θ: contact angles between said rollers and said belt.

22. A color image forming apparatus according to claim 19, wherein a yellow toner image is transferred from one of said plurality of image bearing members to said intermediate transferring member before a conveying direction of said black toner image by said intermediate transferring member is changed.

23. A color image forming apparatus comprising:

developing means for developing toner images of plural colors;

an image bearing member for bearing thereon the toner images of plural colors formed by said developing means;

a rotatable intermediate transferring member for bearing thereon the toner images, said intermediate transferring member being provided with a layer having a volume resistivity of $10^{12}$ to $10^{16}$ Ω.cm; and transferring means for electrostatically transferring said toner images of plural colors on said image bearing member to said intermediate transferring member superposedly at a first transferring position;

wherein a first toner image transferred from said image bearing member to said intermediate transferring member at said first transferring position by said transferring means is a black toner image.

24. A color image forming apparatus according to claim 23, wherein the charging polarity of said image bearing member and the normal changing polarity of the toner in said developing means are the same.

25. A color image forming apparatus according to claim 23, wherein said intermediate transferring member is provided with a base layer having a volume resistivity of $10^2$ to $10^8$ Ω.cm, and a coat layer is coated on said base layer.

26. A color image forming apparatus according to claim 25, wherein said base layer is an elastic layer.

27. A color image forming apparatus according to claim 26, wherein the coat layer coated on said base layer is a resinous layer.

28. A color image forming apparatus according to claim 26, wherein said base layer is a rubber layer.

29. A color image forming apparatus according to claim 23, wherein said intermediate transferring member has a shape of a belt supported by a plurality of rollers.

30. A color image forming apparatus according to claim 29, wherein a following expression is satisfied:

$$R \times 360/\theta \geqq 55$$

where

R: diameters of said rollers (mm), and

θ: contact angles between said rollers and said belt.

31. A color image forming apparatus according to any one of claims 23–29, wherein said plural color toner images comprises the black toner image, a yellow image, a cyan toner image and a magenta toner image.

32. A color image forming apparatus according to claim 31, wherein the last color toner image transferred at said first transferring position from said image bearing member to said intermediate transferring member by said transferring means is the yellow toner image.

33. A color image forming apparatus comprising:

a plurality of image bearing members bearing toner images of plural colors thereon;

a rotatable intermediate transferring member for bearing thereon the toner images, said intermediate transferring member being provided with a layer having a volume resistivity of $10^{12}$ to $10^{16}$ Ω.cm ; and transferring means for transferring said toner images of plural colors on said plurality of image bearing members to said intermediate transferring member sequentially in superposed fashion;

wherein a first toner image transferred from the one of said plurality of image bearing to said intermediate transferring member by said transferring means is a black toner image.

34. A color forming apparatus according to claim 33, further comprising developing means for forming toner images of plural colors on said plurality of image bearing members.

35. A color image forming apparatus according to claim 34, wherein a charging polarity of said plurality of image bearing members and a normal charging polarity of the toners in said developing means are the same.

36. A color image forming apparatus according to claim 33, wherein said intermediate transferring member is provided with a base layer having a volume resistivity of $10^2$ to $10^8$ Ω.cm, and a coat layer is coated on said base layer.

37. A color image forming apparatus according to claim 36, wherein said base layer is an elastic layer.

38. A color forming apparatus according to claim 37, wherein said coat layer coated on said base layer is a resinous layer.

39. A color image forming apparatus according to claim 37, wherein said base layer is a rubber layer.

40. A color image forming apparatus according to any one of claims 33–38, wherein said plural color toner images comprises the black toner image, a yellow image, a cyan toner image and a magenta toner image, respectively, thereon.

41. A color image forming apparatus according to claim 40, wherein said intermediate transferring member is in a shape of a belt supported by a plurality of rollers.

42. A color image forming apparatus according to claim 41, wherein in the direction of rotation of said intermediate member, said yellow toner image is transferred from one of said plurality image bearing members to said intermediate transferring member after said black toner image is transferred from one of said plurality of image bearing members to said intermediate transferring member and before said black toner image arrives at any of supporting positions by said rollers.

43. A color toner image forming apparatus according to claim 41, wherein the yellow toner image is transferred from one of said plurality of image bearing members to said intermediate transferring member before a conveying direction of said black toner image by said intermediate transferring member is changed.

* * * * *

UNITED STATES PATENT AND TRADEMARK OFFICE

CERTIFICATE OF CORRECTION

PATENT NO. : 6,175,702 B1
DATED : January 16, 2001
INVENTOR(S) : Akihiko Takeuchi et al.

It is certified that error appears in the above-identified patent and that said Letters Patent is hereby corrected as shown below:

Column 5,
Line 12, "image" should read -- image forming --.

Column 6,
Line 17, "the of the" should read -- the surface of the --.

Column 11,
Line 15,"sponding" should read -- spondingly --.

Column 13,
Line 56, "in along" should read -- along --.

Column 14,
Line 25, "multiplex" should read -- as a multiplex --.

Column 16,
Line 38, "inter mediate" should read -- intermediate --.
Line 47, "sa id" should read -- said --.
Line 52, "a" should read -- the --.

Column 17,
Line 40, "toner" should read -- toner, --.
Line 47, "means," should read -- means, and --.

Column 19,
Line 14, "yellow" should read -- yellow toner --.
Line 33, "bearing' should read -- bearing members --.

UNITED STATES PATENT AND TRADEMARK OFFICE

CERTIFICATE OF CORRECTION

PATENT NO. : 6,175,702 B1
DATED : January 16, 2001
INVENTOR(S) : Akihiko Takeuchi et al.

It is certified that error appears in the above-identified patent and that said Letters Patent is hereby corrected as shown below:

Column 20,
Line 17, "comprises the" should read -- comprise a --; and "yellow" should read -- yellow toner --.
Line 26, "plurality" should read -- plurality of --.

Signed and Sealed this

Fifteenth Day of January, 2002

*Attest:*

*Attesting Officer*

JAMES E. ROGAN
*Director of the United States Patent and Trademark Office*